United States Patent [19]

Schreiner et al.

[11] Patent Number: 4,671,889

[45] Date of Patent: Jun. 9, 1987

[54] MOLDED GETTER BODIES AND METHOD OF PRODUCING THE SAME

[76] Inventors: Horst Schreiner, Siebenbuerger Strasse 54; Bernhard Rothkegel, Koenigshammerstrasse 82, both of D8500 Nuremberg; Josef Weiser, Bendiktstrasse 9, D8021 Hohenschaeftlarn; Robert Esterl, D8019 Reinstorf bei Glonn, all of Fed. Rep. of Germany

[21] Appl. No.: 697,247

[22] Filed: Feb. 5, 1985

Related U.S. Application Data

[63] Continuation-in-part of Ser. No. 406,862, Aug. 10, 1982, abandoned.

[51] Int. Cl.[4] ..... H01J 7/18

[52] U.S. Cl. ..... 252/181.2; 252/181.6

[58] Field of Search ..... 252/181.1, 181.2, 181.3, 252/181.6; 419/2

[56] References Cited

U.S. PATENT DOCUMENTS

| | | | |
|---|---|---|---|
| 4,118,542 | 10/1978 | Walter | 252/181.6 X |
| 4,360,444 | 11/1982 | Esterl et al. | 252/181.1 |
| 4,385,019 | 5/1983 | Bernstein et al. | 252/181.6 X |
| 4,405,487 | 9/1983 | Harrah et al. | 252/181.2 X |

FOREIGN PATENT DOCUMENTS

| | | | |
|---|---|---|---|
| 670692 | 9/1963 | Canada | 252/181.6 |

OTHER PUBLICATIONS

Neumuller Rompps Chemie-Lexikon (Franckh'ssche Verlagshandlung, Stuttgart) 7th Edition (1977) pp. 3857-3858.

Brochure entitled "Rohstoffe Fur Technische Emulsionen" by Hoechst Aktiengesellschaft Verkauf Kunststoffe Gruppe Wachse und Kunststoff-Additive Gersthofen, Postfach 101567 D-8900 Augsburg 1, West Germany (bearing Hoechst I.D. No. W 258).

Brochure entitled "Licomer-und Hordamer-Dispersionen" by Hoechst Aktiengesellschaft Verkauf Kunststoffe Gruppe Wachse und Kunststoff-Additive Gerthofen, Postfach 101567 D-8900 Augsburg 1, West Germany (bearing Hoechst I.D. No. L 135).

*Primary Examiner*—John F. Terapane
*Assistant Examiner*—Virginia B. Caress
*Attorney, Agent, or Firm*—Hill, Van Santen, Steadman & Simpson

[57] ABSTRACT

The invention relates to molded getter bodies for use in encapsulated electrical components. The getter bodies are formable into compressed body shapes in a simplified manner from a mixture of (A) a getter material consisting of activated carbon, zeolite, zirconium and mixtures thereof, (B) polyamide, and (C) polyethylene wax. The molded getter bodies of the invention have improved accuracy as to size, increased getter capacity, and uniform getter activity relative to the prior art.

10 Claims, 3 Drawing Figures

MOLDED GETTER BODIES AND METHOD OF PRODUCING THE SAME

CROSS-REFERENCE TO RELATED APPLICATION

Attention is directed to copending U.S. Ser. No. 239,571 filed Mar. 2, 1981, now U.S. Pat No. 4,360,444 issued Nov. 13, 1982. This instant application is a continuation-in-part of our earlier filed U.S. patent application Ser. No. 406,862 filed Aug. 10, 1982, now abandoned.

BACKGROUND OF THE INVENTION

1. Field of the Invention

The invention relates to molded getter bodies and to methods of producing such bodies, and, somewhat more particularly, to getter bodies formable into compressed body shapes in a simplified manner from a powder mixture consisting of a getter material, a polyamide, and a binding material.

2. Prior Art

Getter bodies in the form of tablets and the like for use in encapsulated electrical components are known, as taught, for example, from German AS No. 30 08 290 (which corresponds to the above referenced U.S. Pat. No. 4,360,444 assigned to the instant assignee).

In addition to a getter material and a polyamide material, the getter body described in this publication also contains aluminum stearate and polycarbonate. Such body is formed by producing a first mixture consisting of a getter material and a polycarbonate solution which, after mixing, is dried and ground to a uniform particle size, and then a second mixture is formed from a polyamide powder and aluminum stearate, which is mixed with the first mixture, and such resulting admixture is then pressed into getter tablets and the like.

Such known getter bodies exhibit relatively good getter properties and have largely satisfactory mechanical stability. However, on the one hand, manufacture of such bodies is still relatively involved since it comprises numerous processing steps and, on the other hand, such getter bodies must still be barrel-burnished (smoothened) after molding in order to remove any adhering particles therefrom and to deburr the bodies. Further, such known getter bodies exhibit fluctuations in their getter properties as a result of weight fluctations and fluctuations in the uniformity of the composition forming the bodies. Yet further, cracks in such getter bodies perpendicular to the molding direction cannot always be avoided

SUMMARY OF THE INVENTION

The invention provides new and very useful molded getter bodies having improved accuracy as to size, increased getter capacity, and uniform getter activity relative to the prior art.

Further, the invention provides a new method for producing such bodies. The method is simple and adapted for use in automated manufacturing processes, so that, for example, when filling compression molds, a dissociation of the components in the molding composition is avoided, and a volumetic fill with tight dimensional tolerance is achievable for each mold.

In accordance with the invention, a getter body utilizes polyethylene wax as a binding agent.

The use of polyethylene wax as a binding agent in a getter body is surprisingly advantageous in that this material, in accord with the practice of the method of this invention, can be very uniformly mixed with a getter material, such as activated carbon, and with a molding resin, such as a polyamide, so that, after preparation, a granulate molding composition results which has extremely good flow behavior during molding, such as is desirable for use in press molds.

The molded getter bodies of the invention produced by molding such a composition are preferably manufactured with tight dimensional tolerances and characteristically exhibit a very uniform material composition as well as a high uniformity in getter properties which properties, moreover, are better than those exhibited by known activated carbon getter tablets. Further, the molded getter bodies of the invention are produced substantially crack-free with the improved molding compositions, and the molded getter bodies exhibit sufficient ductility, even after optional hardening, so as not to break when, for example, a product molded getter body is forced into a fastening groove or the like of an electrical component at the time of use.

Other and further objects, aims, purposes, features, advantages, embodiments and the like will be apparent to those skilled in the art from the teachings of the present application taken with the accompanying drawings.

DETAILED DESCRIPTION

Figure 1:
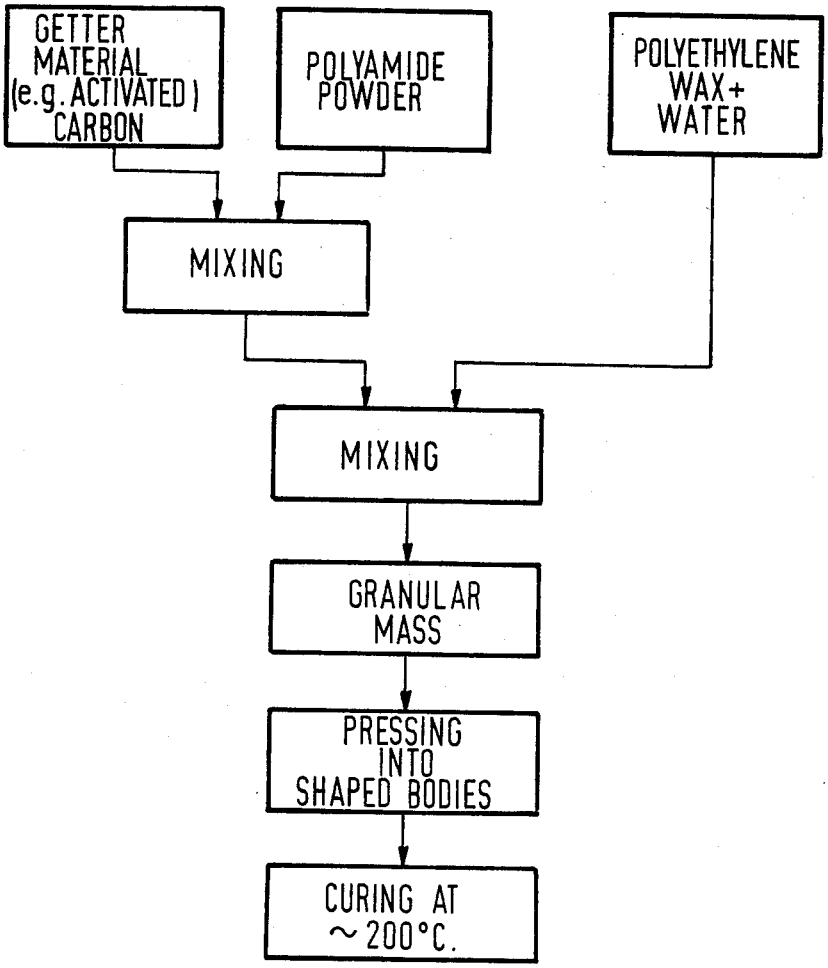
FIG. 1 is a block diagram illustrating a preferred embodiment of a method of producing molded getter bodies in accordance with the present invention.

In accordance with the present invention, a getter body molding composition, and the getter bodies moldable therefrom, each comprise on an overall 100 weight percent total basis in uniform combination:

(a) from about 20 to 40 weight percent of getter material, (b) from about 20 to 40 weight percent of polyamide, and (c) from about 20 to 40 weight percent of polyethylene wax.

In preferred embodiments of the invention, approximately equal respective portions of one-third each of the above materials are utilized (same basis).

The method of producing the molded getter bodies of the invention proceeds in such a manner that, first, the getter material, for example activated carbon powder, zeolite powder, zirconium powder, or the like, is directly mixed with the polyamide in a finely divided powder form. Then, the polyethylene wax in the form of a water dispersion is added to this mixture and is uniformly distributed and mixed therewith so as to attain a uniform mass. This mass is then dried, granulated or ground, and formed into a moldable particulate or granular composition which is pressed (molded) into the desired shaped getter bodies of this invention. The dried granulated mass can be screened to remove therefrom any coarse fractions, which fraction so removed can then be regranulated or reground and then recycled into admixture with the product molding composition.

A further advantage of the moldable getter body composition of the invention is that a high proportion of free-flowing granular material is attainable for use as a molding composition as a result of drying and granulating so that such granular material can then be directly molded. If desired, any oversized particles or agglomerations can be reground in a simple matter into the moldable granular mass which preferably has particle sizes of a selected size range. In preferred embodiments of the invention, the moldable granular mass is composed of particles having an average grain or particle size of less than about 0.5 mm diameter, particularly when such mass is to be used for the production of molded getter bodies for use in electrical components, such as relays, which getter bodies are designed to have a uniform interior dimension or diameter of not greater than about approximately 3 mm.

In order to provide increased stability for the molded getter bodies of the invention, the compressed molded getter bodies formed from such a molded granular composition are optionally hardened or cured by a thermal treatment in air at a temperature of preferably approximately 200° C., and broadly from about 160° to 240° C., although higher and lower temperatures may be employed without departing from the spirit and scope of this invention.

The getter materials employed in the practice of this invention preferably initially have average particle size which are less than about 140 microns, and more preferably are less than about 75 microns. Also, such a getter material preferably initially has a surface area which is at least about 200 square meters per gram, and more preferably is at least about 800 square meters per gram. The presently most preferred getter material comprises activated carbon powder. Smaller and larger such particle sizes and surface areas can be used if desired.

The polyamide employed in the practice of this invention can be of any particular moldable type, such as a copolymer of a diamine and a dicarboxylic acid, like the polyamide based on hexamethylene diamine and adipic acid, or a polylactam polymer, like the polyamide based on caprolactam, or the like. Polyamides which thermoset readily at temperatures above about 160° C. can be used and are preferred, but polyamides having higher and lower thermosetting temperatures can be used.

The polyamide used in the practice of this invention is initially in a powdered form. Preferably, the polyamide has an average particle size which is less than about 400 microns and more preferably such polyamide has an average particle size in the range from about 100 to 200 microns. If desired, a starting polyamide can be purchased in the form of conventionally sized molding pellets, and such pellets can be passed through a so-called micronizer or the like to produce the powdered forms desired. Higher and lower particle sizes for the polyamide can be used if desired.

The polyethylene employed in the practice of the invention is characterized by being initially at least water dispersable, and preferably is water emulsifiable. It is also film forming, as when an aqueous colloidal dispersion of such a polyethylene wax is applied to a solid substrate surface and then is dried to remove residual water.

Such a polyethylene wax itself is not oxidized, so that carbonyl, hydroxyl, and carbonyl, hydroxyl, and carboxyl groups are characteristically not present therein. Suitable polyethylene waxes are well known and available commercially.

A presently preferred polyethylene wax for use in this invention is a nonionic polyethylene wax which is capable of being formed into an aqueous wax-in-water emulsion. Such a polyethylene wax can incorporate into its molecular structure during polymerization at least one alkyl polyglycol ether chain per molecule.

Another suitable polyethylene wax is an anionic polyethylene wax which is capable of being formed into an aqueous wax-in-water emulsion. Such a polyethylene wax can incorporate pendant sulfonic acid groups in its molecular structure. Such an incorporation can be accomplished by polymerizing ethylene in the presence of ethylene sulfonic acid, for example.

The structure and preparation of colloidally dispersable polyethylene waxes is well known to those skilled in the art.

As utilized in the practice of the present invention, the colloidally dispersable polyethylene wax is initially in the form of a colloidal aqueous dispersion. The preparation of such dispersions is well known in the art and is described, for example, in the publication No. W258 by Hoechst Aktiengesellschaft (Verkauf Kunststoffe, Gruppe Wachse and Kunststoff-Additive, Gersthofen, Postfach 101567, D-8900 Augsburg 1, West Germany), and elsewhere. Typically such water emulsions are prepared either in ambient pressures or in low pressure autoclaves. For example, to prepare a wax-in-water emulsion, a polyethylene wax and emulsifier are heated in a melting pot at about 120°–130° C. In a second vessel, the chosen amount of water for a particular formulation is warmed to the specified emulsification temperature. The melted polyethylene wax in a thin stream with emulsifier is charged into the so prepared water. After the addition of the polyethylene wax is completed, the emulsion is cooled to room temperature and filtered.

Such aqueous colloidal dispersions of polyethylene wax are available commercially, and, for reasons of cost and manufacturing convenience, it is preferred to employ such commercially-prepared dispersions as starting materials for use in the practice of this invention. For example, the above indicated preferred nonionic polyethylene wax is available commercially as a 40 weight percent aqueous emulsion from Hoechst in the United States under the trademark "Hordamer PE 03". This emulsion has a pH ranging from about 6.0 to 8.0, a viscosity at 25° C. by ASTM D 445-65 of not less than 50, a density at 20° C. of from 0.96 to 0.98 by ASTM D 1298-67, and a minimum film forming temperature of not less than 10 by DIN 53 787. This emulsion constitutes a presently most preferred starting material for use in the practice of this invention.

For another example, the above indicated anionic polyethylene wax is available commercially as a 40 weight percent aqueous emulsion from Hoechst in the Untied States under the trademark "Hordamer PE 02". This emulsion has a pH ranging from about 10.5 to 11.5, a viscosity at 25° C. by ASTM D 445-65 of not less than 50, a density of 20° C. of from 0.96 to 0.98 by ASTM D 1298-67, and a minimum film forming temperature of not less than 10 by DIN 53 787. This emulsion is a presently preferred starting material for use in the practice of this invention.

In general, for use in the present invention, such an aqueous colloidal dispersion can have, on a total 100 weight percent basis, a polyethylene wax solids content ranging from about 20 to 55 weight percent, although lower and higher solids contents can be employed if desired and if obtainable. Also, in general, the polyethylene wax particle size in such a colloidal dispersion is less than about 200 millimicrons, and more preferably is in the range from about 75 to 100 millimicrons. Small and larger such particle sizes can be used.

It is presently preferred to dry a composite intermediate uniform blend of powdered getter material, powdered polyamide, and aqueous colloidal dispersion of polyethylene wax under atmospheric conditions at an elevated temperature which temperature is below the melt softening temperatures, respectively, of the polyethylene wax and the polyamide. Typically suitable drying temperatures are below about 200° C. More preferably, the drying temperature ranges from about 80° to 135° C. which preferably is applied inversely for a time of from about 3 to 0.2 hours.

After such drying, it is presently preferred to grind the dried product to an extent sufficient to produce a powdered moldable product composition having an average particle size which is less than about 1 millimeter and more preferably which is less than about 0.5 millimeter. Coarse particles are preferably removed by screening, and separated coarse particles are reground to a desired such particle size, and then admixed with powdered product moldable composition.

In mixing together the powdered getter material and the powdered polyamide resin, it is convenient to employ from about 40 to 60 weight percent of each on a total 100 weight percent mixture basis. Preferably about equal quantities of such respective substances are employed.

The effect of the mixing of the aqueous dispersion of polyethylene wax with the particulate polyamide and particulate getter material is to provide a layer or film of the polyethylene wax about individual such particles or small clusters of such particles.

While the presently described method for preparation of a powdered molding composition of this invention is preferred, those skilled in the art will appreciate that other preparation methods can be employed so that the molding compositions of this invention can be prepared by more than one method. Examples of other methods of preparation include (a) spray coating particulate polyamide and getter materials in a tower with an aqueous dispersion of polyethylene wax, (b) preliminarily separately batch coating particulate polyamide powder and getter material powder drying, granulating, and thereafter admixing together the separately so prepared batches, and the like. Regardless of preparation procedure, the molding compositions of this invention preferably have a particle size as above indicated.

Typically, a compression molded getter body of this invention produced from a molding composition of this invention has a structure wherein the polyethylene wax is a continuous phase with said polyamide particles and said getter material particles being distributed therein as respective discrete phases.

In the drawings, FIG. 1 illustrates the basic steps utilized in producing the molded getter bodies of the invention. FIG. 1 is believed to be self explanatory.

Figure 2A:
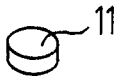
FIG. 2*a* is a perspective view of one form (greatly enlarged) of an exemplary getter body produced in accordance with the principles of the invention.

FIG. 2*a* illustrates a circular or cylindrical getter body producable in accordance with the principles of the invention.

Figure 2B:
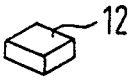
FIG. 2*b* is a perspective view of another form (greatly enlarged) of an exemplary molded getter body produced in accordance with the principles of the invention.

FIG. 2*b* illustrates a rectangular or square getter body 12 producable in accordance with the principles of the invention.

Of course, other geometrical shapes can also be readily produced as desired in a getter body of this invention.

PREFERRED EMBODIMENTS

The present invention is further illustrated by reference to the following examples. Those skilled in the art will appreciate that other and further embodiments are obvious and within the spirit and scope of this invention from the teachings of these present examples taken with the accompanying specification.

EXAMPLES

In producing certain molded getter bodies, activated carbon powder having particles of an average size (diameter) less than about 60 μm was selected as the getter material and such was uniformly admixed with an approximately equal amount by weight of polyamide powder having a particle size of less than about 160 μm. This mixing step can occur in a commercially available or standard mixing device, such as a biconial mixer, a bifurcated mixer, a paddle mixer, or the like. Polyethylene wax emulsified in water ("Hordamer PE 03") was then added to the above mixture and uniformly blended in. Overall, the respective dry weight proportions of getter material, polyamide powder, and polyethylene wax solids were approximately equal in the resulting composition.

The mixture produced in the above described manner was then dried on a drying plate in air while maintained at a temperature below about 90° C. Subsequently, the dried mixture was put through a grinder and then passed through a screening device so that granular particles having a size of less than 0.5 mm were removed while coarser particles were reground and recycled until all particles attained a particle size of less than 0.5 mm. The grinding and size separation occurred in a conventional toothed plate mill. Next, with an automatic dry press machine, the relatively fine sized dry particles were molded into cylindrical getter bodies having a diameter of 3.4 mm and a height of 1.5 mm. The dimensional accuracy of the molded parts so automatically pressed (molded) in this manner amounted to approximately ±3%. The so-produced molded getter bodies were carefully examined and exhibited no visible cracks.

These bodies were then hardened into shape-stable bodies by a thermal treatment in air at about 200° C. for 20 minutes.

In order to determine their mechanical strength, these hardened bodies were radially loaded with 35 N (Newtons) between flat plates without breakage. Accordingly, such bodies exhibited sufficient stability to be pressed into slot-shaped mounts or to be placed in receiving areas of electrical components without fracturing, as desired.

The getter effect of the above-produced molded getter bodies was next checked. A larger number of the above described hardened getter bodies were weighed and subsequently placed in a vacuum chamber at 110° C. Thereafter, these getter bodies were stored with styrol in a closable metal container. After 22 hours of storage time at room temperatures, the increase in weight of each of the bodies was determined. In this manner, the relative getter capacity of bodies, which initally has an individual weight of 11 mg, was determined to be 0.3 mg. With activated carbon getter bodies of equal size, but of a traditional prior art composition, this relative getter capacity amounted to only 0.2 mg per tablet. The getter rate, i.e., the weight increase after a specific time, was also greater with the getter tablets of the invention in comparison to such similarly shaped tablets produced in accordance with the prior art.

As is apparent from the foregoing specification, the present invention is susceptible of being embodied with various alterations and modifications which may differ particularly from those that have been described in the preceding specification and description. For this reason, it is to be fully understood that all the foregoing description is intended to be merely illustrative, and it is not to be construed or interpreted as being restrictive or otherwise limiting of the present invention, excepting as it is set forth and defined in the hereto-appended claims.

We claim:

1. A molding composition useful for molding getter bodies comprising on a 100 weight percent total composition basis:

(A) from about 20 to 40 weight percent of a powdered getter material selected from the group consisting of activated carbon, zeolite, zirconium, and mixtures thereof, (B) from about 20 to 40 weight percent of a powdered polyamide, and (C) from about 20 to 40 weight percent of a polyethylene wax, said polyethylene wax having been coated about individual particles or clusters of individual particles of said powdered getter material and of said powdered polyamide, said molding composition being in the form of particles having average sizes under about 1 millimeter.

2. The composition of claim 1 wherein (a) said getter material has an initial average particle size which is less than about 140 microns, and (b) said polyamide has an initial average particle size which is less than about 400 microns.

3. The composition of claim 2 wherein said getter material is activated carbon.

4. The composition of claim 1 wherein approximately equal quantities of each of said getter material, said polyamide and said polyethylene wax are present.

5. A getter body produced by compression molding a composition of claim 2.

6. A getter body produced by compression molding a composition of claim 3.

7. A getter body produced by compression molding a composition of claim 4.

8. A getter body produced by compression molding a powdered molding composition produced by the steps of:

(A) mixing together in a powdered form on a 100 weight percent total mixture basis (a) from about 40 to 60 weight percent of a getter material selected from the group consisting of activated carbon, zeolite, zirconium, and mixtures thereof, and (b) from about 40 to 60 weight percent of a polyamide resin, until a uniform mixture is produced, (B) blending with said uniform mixture an aqueous colloidal dispersion of a polyethylene wax until a uniform blend is produced, the quantity of said polyethylene wax in said blend being from about 20 to 40 weight percent of the total blend on a dry weight basis, (C) drying said uniform blend at a temperature below about 200 degrees C, and (D) granulating the so dried blend to produce a powdered composition whose average particle size is less than about 1 millimeter.

9. A getter body produced by compression molding a molding composition comprising on a 100 weight percent total composition basis:

(A) from about 20 to 40 weight percent of a powdered getter material selected from the group consisting of activated carbon, zeolite, zirconium, and mixtures thereof, (B) from about 20 to 40 weight percent of a powdered polyamide, and (C) from about 20 to 40 weight percent of a polyethylene wax, said polyethylene wax having been coated about individual particles or clusters of individual particles of said powdered getter material and of said powdered polyamide, said molding composition being in the form of particles having average sizes under about 1 millimeter.

10. A getter body comprising on a 100 weight percent total composition basis:

(A) from about 20 to 40 weight percent of a powdered getter material selected from the group consisting of activated carbon, zeolite, zirconium and mixtures thereof, (B) from about 20 to 40 weight percent of polyamide particles, and (C) from about 20 to 40 weight percent of polyethylene wax, said polyethylene wax being a continuous phase with said polyamide and said getter material being distributed therein as respective discrete phases.

* * * * *